US008827769B2

(12) United States Patent
Nakanishi et al.

(10) Patent No.: US 8,827,769 B2
(45) Date of Patent: Sep. 9, 2014

(54) METHOD OF PRODUCING SUBSTRATE FOR MAGNETIC RECORDING MEDIA

(75) Inventors: Yasuyuki Nakanishi, Oyama (JP); Hidenori Inada, Oyama (JP); Katsuhiro Yoshimura, Yuki (JP)

(73) Assignee: Showa Denko K.K., Tokyo (JP)

( * ) Notice: Subject to any disclaimer, the term of this patent is extended or adjusted under 35 U.S.C. 154(b) by 509 days.

(21) Appl. No.: 13/209,880

(22) Filed: Aug. 15, 2011

(65) Prior Publication Data

US 2012/0045974 A1 Feb. 23, 2012

(30) Foreign Application Priority Data

Aug. 17, 2010 (JP) ..... 2010-182331

(51) Int. Cl.
*B24B 1/00* (2006.01)
*B24B 37/08* (2012.01)

(52) U.S. Cl.
CPC ..... *B24B 37/08* (2013.01)
USPC ..... 451/37; 451/41; 451/57; 451/60; 451/63

(58) Field of Classification Search
CPC ..... B24B 1/00; B24B 37/042; B24B 37/044; B24B 7/241; C23F 1/28; G11B 5/8408
USPC ..... 51/308; 216/22, 88, 89; 427/130; 451/36, 37, 41, 57, 60, 63; 510/369
See application file for complete search history.

(56) References Cited

U.S. PATENT DOCUMENTS 5,902,172 A * 5/1999 Utashiro ..... 451/28
8,241,516 B2 * 8/2012 Fujii et al. ..... 216/89
2004/0010979 A1 * 1/2004 Oshima et al. ..... 51/307

(Continued)

FOREIGN PATENT DOCUMENTS

JP 62-208869 A 9/1987
JP 04-129664 A 4/1992

(Continued)

OTHER PUBLICATIONS

Japanese Office Action issued application No. 2010-182331 dated Feb. 18, 2014.

*Primary Examiner* — Timothy V Eley
(74) *Attorney, Agent, or Firm* — Sughrue Mion, PLLC

(57) ABSTRACT

There is provided a method of producing a substrate for magnetic recording media which is capable of efficiently removing alumina abrasive grains in the latter polishing step that have been stuck in the former polishing step during polishing of the substrate for magnetic recording media in which a NiP plating film has been formed on the surface of an Al alloy substrate, the method including:

a rough polishing step for polishing the surface of a substrate for magnetic recording media, which is prepared by forming a NiP plating film on the surface of an Al alloy substrate, using a first grinder while supplying a polishing liquid containing alumina abrasive grains; and a finish polishing step for polishing the substrate for magnetic recording media following washing, using a second grinder while supplying a polishing liquid containing colloidal silica abrasive grains, wherein supply of the polishing liquid containing alumina abrasive grains is stopped and alumina abrasive grains are removed from the grinder by supplying a washing liquid containing no abrasive grains instead at the end of the rough polishing step, followed by an intermediate polishing step provided for polishing the surface of the substrate for magnetic recording media using the first grinder while supplying a polishing liquid containing colloidal silica abrasive grains.

6 Claims, 1 Drawing Sheet

(56) References Cited

U.S. PATENT DOCUMENTS

| | | | | |
|---|---|---|---|---|
| 2004/0162012 | A1* | 8/2004 | Suenaga et al. | 451/41 |
| 2004/0266323 | A1* | 12/2004 | Oshima et al. | 451/41 |
| 2005/0221726 | A1* | 10/2005 | Honma et al. | 451/41 |
| 2008/0188165 | A1* | 8/2008 | Sakaguchi et al. | 451/259 |
| 2009/0111359 | A1 | 4/2009 | Suzuki et al. | |
| 2010/0221417 | A1* | 9/2010 | Miyamoto et al. | 427/129 |
| 2011/0151752 | A1* | 6/2011 | Ono et al. | 451/41 |
| 2011/0203186 | A1* | 8/2011 | Oshima et al. | 51/298 |
| 2013/0309946 | A1* | 11/2013 | Hamaguchi | 451/59 |
| 2014/0001155 | A1* | 1/2014 | Hamaguchi | 216/89 |

FOREIGN PATENT DOCUMENTS

| | | | |
|---|---|---|---|
| JP | 2000-280171 | A | 10/2000 |
| JP | 2004-182800 | A | 7/2004 |
| JP | 2005-149603 | A | 6/2005 |
| JP | 2007-168057 | A | 7/2007 |
| JP | 2009-176397 | A | 8/2009 |

* cited by examiner

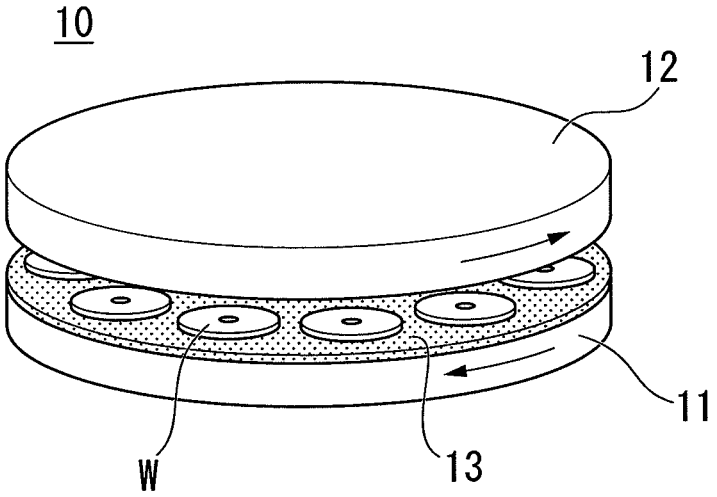
10
12
11
W
13

METHOD OF PRODUCING SUBSTRATE FOR MAGNETIC RECORDING MEDIA

BACKGROUND OF THE INVENTION

1. Field of the Invention

The present invention relates to a method of producing a substrate for magnetic recording media in which a NiP plating film has been formed on the surface of an Al alloy substrate.

2. Description of Related Art

In recent years, the improvements in the recording density of magnetic recording media that are used in a hard disk drive has been dramatic. In particular, since the introduction of a magnetoresistive (MR) head or a partial response maximum likelihood (PRML) technique, the increase in surface recording densities has become even more dramatic, and the more recent introduction of a giant magnetoresistive (GMR) head, a tunnel magnetoresistive (TMR) head or the like has meant that recording densities continue to increase at a pace of about 1.5 times a year.

There are still strong demands for even higher recording densities for these magnetic recording media, and in order to satisfy these demands, higher coercive force and higher signal to noise ratio (SNR) of the magnetic recording layer and higher levels of resolution are required.

Further, in recent years, concurrently with the improvements in linear recording density, efforts are also continuing into raising the surface recording density by increasing the track density. For this reason, with regard to the substrates used for magnetic recording media, smoother substrates with fewer scratches have been demanded more than ever before.

Al alloy substrates and glass substrates are mainly used as such substrates for magnetic recording media (namely, disc substrates). Of these, as compared to glass substrates, Al alloy substrates exhibit higher toughness and can be produced more easily, and are thus used for magnetic recording media having a relatively large diameter.

In addition, Al alloy substrates are generally produced through the following steps. First, an Al alloy plate having a thickness of about 2 mm or less is punched out into a doughnut shape to form a substrate with a desired size. Subsequently, the punched substrate is subjected to a chamfering process for the inner and outer diameters and a turning process for the data surface, followed by a grinding process using a grindstone in order to reduce the levels of surface roughness and swelling after the turning process. Thereafter, NiP plating is applied to the substrate surface in order to provide surface hardness as well as to suppress surface defects. Then, a polishing process is conducted on both sides (data surfaces) of the substrate where this NiP plating film has been formed.

Incidentally, in the polishing process for the Al alloy substrates described above, in view of improving both the surface quality (in terms of smoothness and the number of scratches) and the productivity, a multi-stage polishing system involving two or more stages of polishing steps using a plurality of independent grinders has been employed in many cases.

In the polishing step (also referred to as a rough polishing step) at an initial stage in this multi-stage polishing system, in view of productivity, polishing is conducted using abrasive grains such as alumina abrasive grains having a relatively large particle size so as to achieve a high polishing speed. On the other hand, in the final polishing step (also referred to as a finish polishing step) in the multi-stage polishing system, in order to satisfy the requirements to reduce the levels of surface roughness and swelling and the number of scratches, polishing using colloidal silica abrasive grains is generally conducted.

However, when alumina is used as abrasive grains, since alumina abrasive grains exhibit considerably high hardness compared to Al alloy substrates, alumina abrasive grains stick deep into the substrate to cause various problems. For example, these alumina abrasive grains that have been stuck are difficult to remove in the following polishing step, and when they are detached, substrates are damaged by these detached alumina abrasive grains.

As described above, in the multi-stage polishing system, the polishing amount of substrates reduces as the stage progresses and also the abrasive grains included in the abrasives become softer and smaller in terms of particle size. For this reason, the abrasive grains that have been stuck in the former polishing step are difficult to remove in the latter polishing step, and when the abrasive grains that have been stuck are detached to cause damages to the substrates, these damages are difficult to eliminate in the latter polishing step.

For this reason, it has been proposed to use a polishing liquid composition containing both alumina abrasive grains and silica abrasive grains as a polishing liquid composition capable of reducing the sticking of alumina abrasive grains during polishing of Al alloy substrates (refer to Patent Document 1).

In those cases where the polishing liquid composition described in Patent Document 1 is used, since the alumina abrasive grains that have been stuck to the substrates are removed by the silica abrasive grains, it is possible to remove the alumina abrasive grains that have been stuck to the substrates to some extent. However, as long as this polishing liquid composition is used, there is a possibility that the alumina abrasive grains included in the abrasives would stick into the substrates. In addition, since this polishing liquid composition contains both alumina abrasive grains and silica abrasive grains, a high polishing performance exhibited by the alumina abrasive grains cannot be fully utilized, thereby reducing the polishing speed.

Further, in order to reduce the cost for producing substrates, it is required to reduce the number of polishing steps conducted in the multi-stage polishing system. In Patent Document 2, a polishing method employing multiple types of slurries in one grinder has been described.

[Patent Document 1] Japanese Unexamined Patent Application, First Publication No. 2009-176397

[Patent Document 2] Japanese Unexamined Patent Application, First Publication No. 2000-280171

SUMMARY OF THE INVENTION

The present invention has been developed in light of the above circumstances, and has an object of providing a method of producing a substrate for magnetic recording media. During polishing of a substrate for magnetic recording media in which a NiP plating film has been formed on the surface of an Al alloy substrate, the method efficiently removes the alumina abrasive grains in the latter polishing step that have been stuck in the former polishing step, and also enables reduction of the cost for producing the substrates.

In other words, the present invention provides the following means.

(1) A method of producing a substrate for magnetic recording media characterized by including: a rough polishing step for polishing the surface of a substrate for magnetic recording media, which is prepared by forming a NiP plating film on the surface of an Al alloy substrate, using a first grinder while supplying a polishing liquid containing alumina abrasive grains; and a finish polishing step for polishing the substrate for magnetic recording media following washing, using a second grinder while supplying a polishing liquid containing colloidal silica abrasive grains, wherein supply of a polishing liquid containing alumina abrasive grains is stopped and alumina abrasive grains are removed from the grinder by supplying a washing liquid containing no abrasive grains instead at the end of the rough polishing step, followed by an intermediate polishing step provided for polishing the surface of the substrate for magnetic recording media using the first grinder while supplying a polishing liquid containing colloidal silica abrasive grains.

(2) The method of producing a substrate for magnetic recording media described in the above aspect (1) characterized by using water as the washing liquid containing no abrasive grains.

(3) The method of producing a substrate for magnetic recording media described in the above aspect (1), characterized in that a volume-based 50% cumulative average particle size (D50) for the alumina abrasive grains used in the rough polishing step is 0.1 to 0.7 μm, and a volume-based 50% cumulative average particle size (D50) for the colloidal silica abrasive grains used in the intermediate polishing step is 15 to 400 nm.

(4) The method of producing a substrate for magnetic recording media described in any one of the above aspects (1) to (3), characterized in that a volume-based 50% cumulative average particle size (D50) for the colloidal silica abrasive grains used in the finish polishing step is 5 to 180 nm.

As described above, the method of producing a substrate for magnetic recording media according to the present invention includes: a rough polishing step for polishing the surface of a substrate for magnetic recording media, which is prepared by forming a NiP plating film on the surface of an Al alloy substrate, using a first grinder while supplying a polishing liquid containing alumina abrasive grains; and a finish polishing step for polishing the substrate for magnetic recording media following washing, using a second grinder while supplying a polishing liquid containing colloidal silica abrasive grains, wherein supply of a polishing liquid containing alumina abrasive grains is stopped and alumina abrasive grains are removed from the grinder by supplying a washing liquid containing no abrasive grains instead at the end of the rough polishing step, followed by an intermediate polishing step provided for polishing the surface of the substrate for magnetic recording media using the first grinder while supplying a polishing liquid containing colloidal silica abrasive grains. As a result, it becomes possible to efficiently remove the alumina abrasive grains that have been stuck into the substrate for magnetic recording media while reducing the extent of sticking of the alumina abrasive grains into the substrate for magnetic recording media.

BRIEF DESCRIPTION OF THE DRAWINGS

FIG. 1 is a perspective view for explaining steps for producing a substrate for magnetic recording media to which the present invention is applied.

DETAILED DESCRIPTION OF THE INVENTION

More specific explanations for the method of producing a substrate for magnetic recording media according to an embodiment of the present invention will be provided below with reference to the drawings.

It should be noted that those drawings used in the following explanation are showing characteristic portions enlarged in some cases, in order to make them easy to understand, for the sake of simplicity, and thus the size and ratio of each component are not necessarily the same as the actual size and ratio thereof. In addition, the materials, size and the like mentioned in the following explanation are merely an example, and the present invention is not necessarily limited to these and can be modified appropriately and carried out without departing from the spirit and scope of the invention.

The substrate for magnetic recording media to which the present invention is applied (hereafter, simply referred to as a substrate) is formed by applying NiP plating onto a disc-shaped Al alloy substrate having a central hole, thereby forming a NiP plating film on the surface of this Al alloy substrate. In addition, the magnetic recording medium is constituted of a magnetic layer, a protective layer, and a lubricant film or the like which are sequentially laminated on top of the surface of this substrate. Further, in a magnetic recording and reproducing system of a hard disk drive (HDD), the central portion of this magnetic recording medium is attached to the rotation shaft of a spindle motor, so that information is read from, or written onto, the magnetic recording medium using a magnetic head that floats above the surface of the magnetic recording medium rotated by the spindle motor.

In the method of producing a substrate for magnetic recording media according to the present invention, after the application of NiP plating on the Al alloy substrate, a polishing process is conducted on the surface of this substrate. In addition, in the present invention, in view of improving both the surface quality (in terms of smoothness and the number of scratches) and the productivity, a multi-stage polishing system involving two or more stages of polishing steps using a plurality of independent grinders has been employed.

More specifically, the present invention includes a rough polishing step as a step for polishing the surface of a substrate, using a first grinder while supplying a polishing liquid containing alumina abrasive grains; and a finish polishing step for polishing the substrate for magnetic recording media following washing, using a second grinder while supplying a polishing liquid containing colloidal silica abrasive grains.

Here, for example, as shown in FIG. 1, the first and second grinders are equipped with a pair of vertically aligned surface plates 11 and 12, and a plurality of substrates W are sandwiched between the surface plates 11 and 12 which are rotating in the opposite direction from each other, so that both sides of these substrates W are polished by a polishing pad 13 provided in the surface plates 11 and 12.

For example, the polishing pad 13 may be a hard polishing cloth formed of urethane. In addition, when polishing the surface of the substrate W using this polishing pad, a polishing liquid is provided to both sides of the substrate W. For the polishing liquid, for example, slurries prepared by dispersing abrasive grains in a known solvent such as water, methanol, ethanol, propanol, isopropanol and butanol can be used. Further, known additives such as oxidizing agents, surfactants, dispersants and anticorrosive agents can be added to the solvent where appropriate.

As described above, in the present invention, the rough polishing step and the finish polishing step are conducted separately using different grinders. Accordingly, the polishing pads employed in each of these polishing steps use abrasive grains with different physical properties and particle size. For this reason, it is preferable to use different types of polishing pads which are suited for each step. Further, it is also preferable to conduct these steps separately using different grinders, in view of productivity, since washing of the polishing pads is not required.

It should be noted that if the same grinder and polishing pad are used in both polishing steps, it is necessary to include a washing step, between both polishing steps, for rinsing the abrasive grains away while rotating the substrate, in order to conduct both polishing steps continuously. In this case, since the sliding resistance of a substrate or jig relative to the polishing pad increases which may damage the polishing pad or substrate, it is necessary to pay attention to the types of polishing slurry, washing liquid, or the like to be used.

For the washing liquid, water, methanol, ethanol, propanol, isopropanol and butanol can be used in the present invention. Further, known additives such as oxidizing agents, surfactants, dispersants and anticorrosive agents can be added to the washing liquid where appropriate. In the present invention, it is particularly desirable to use water as the washing liquid.

The present invention is characterized by including: a rough polishing step for polishing the surface of a substrate for magnetic recording media, which is prepared by forming a NiP plating film on the surface of an Al alloy substrate, using a first grinder while supplying a polishing liquid containing alumina abrasive grains; and a finish polishing step for polishing the substrate for magnetic recording media following washing, using a second grinder while supplying a polishing liquid containing colloidal silica abrasive grains, wherein supply of a polishing liquid containing alumina abrasive grains is stopped and alumina abrasive grains are removed from the grinder by supplying a washing liquid containing no abrasive grains instead at the end of the rough polishing step, followed by an intermediate polishing step provided for polishing the surface of the substrate for magnetic recording media using the first grinder while supplying a polishing liquid containing colloidal silica abrasive grains.

More specifically, first, the surface of the substrate for magnetic recording media is roughly polished by using a polishing liquid containing alumina abrasive grains. As a result, polishing can be conducted at a high polishing speed (in other words, an adequate polishing speed).

Subsequently, supply of the polishing liquid containing alumina abrasive grains is stopped, and the surface of the substrate for magnetic recording media is polished (through a polishing process where the amount of alumina abrasive grains is gradually reduced) by supplying a washing liquid containing no abrasive grains (such as water) to the first grinder. As a result, it becomes possible to gradually reduce the proportion of alumina abrasive grains that remain on the first grinder, thereby reducing the extent of sticking of alumina abrasive grains into the substrate for magnetic recording media.

Then, supply of the washing liquid containing no abrasive grains is stopped, and the surface of the substrate having a NiP plating film formed thereon is polished (intermediate polishing step) by supplying a polishing liquid containing colloidal silica abrasive grains to the first grinder.

At this stage, hardly any alumina abrasive grains are remained on the first grinder. For this reason, the alumina abrasive grains that have been stuck into the substrate for magnetic recording media can be efficiently removed by conducting a polishing process using a polishing liquid containing colloidal silica abrasive grains.

Thereafter, the finish polishing step is conducted using a second grinder while supplying a polishing liquid containing colloidal silica abrasive grains.

For example, when a polishing step using the first grinder is conducted for 7 minutes, the first rough polishing step is carried out for 3 minutes using alumina abrasive grains, followed by a step of removing the alumina abrasive grains from the grinder by supplying a washing liquid for 2 minutes, and the intermediate polishing step using colloidal silica abrasive grains is carried out for 2 minutes that are remaining.

As described above, in the present invention, by employing such an intermediate polishing step, the alumina abrasive grains that have been stuck into the substrate through the initial polishing process using alumina abrasive grains in the first grinder can be removed through the washing step using a washing liquid and the later polishing process using colloidal silica abrasive grains. Further, this step can be carried out using a single grinder.

In the present invention, it is preferable that a volume-based 50% cumulative average particle size (D50) for the alumina abrasive grains used in the rough polishing step be 0.1 to 0.7 μm, and that a volume-based 50% cumulative average particle size (D50) for the colloidal silica abrasive grains used in the intermediate polishing step be 15 to 400 nm.

As a result, it is possible to reduce the extent of sticking of alumina abrasive grains into the substrate while efficiently removing the alumina abrasive grains that have been stuck into the substrate with the colloidal silica abrasive grains.

In addition, in the present invention, the concentration (slurry concentration) of abrasive grains in the polishing liquid (polishing slurry) is preferably adjusted from 1 to 50% by mass, more preferably from 3 to 40% by mass, and still more preferably from 5 to 10% by mass. This is because an adequate level of polishing performance is difficult to achieve when the slurry concentration is less than 1% by mass, whereas when the slurry concentration exceeds 50% by mass, the viscosity of the polishing slurry increases to adversely affect the fluidity, which may roughen the polished surface of the substrate, and an excessive use of abrasive grains is also uneconomical.

In the present invention, it is preferable that a volume-based 50% cumulative average particle size (D50) for the colloidal silica abrasive grains used in the finish polishing step be 5 to 180 nm. As a result, it becomes possible to remove scratches on the surface of the substrate and to produce a substrate with a high level of smoothness.

In addition, it is particularly preferable that the average particle size for the colloidal silica abrasive grains used in the finish polishing step be smaller than the average particle size for the colloidal silica abrasive grains used in the intermediate polishing step in view of removing the alumina abrasive grains that have been stuck into the substrate and also producing the substrates having a surface with a high level of smoothness.

It should be noted that the present invention is not limited to the embodiments described above, and various modifications can be made without departing from the spirit and scope of the present invention.

EXAMPLES

The advantageous effects of the present invention will be described below in more detail based on a series of examples. It should be noted that the present invention is not limited to the following examples and can be appropriately modified without departing from the spirit and scope of the invention.

Examples 1 and 2

In Examples 1 and 2, substrates were produced under the following conditions. First, the edges of the inner and outer circumferences and the data surfaces of a doughnut shaped blank material (a product equivalent to 5086) made of an aluminum alloy and having an outer diameter of 65 mm, an inner diameter of 20 mm and a thickness of 1.3 mm were subjected to a turning process, and then an electroless NiP plating treatment was conducted across the entire surface to form a plating film with a thickness of about 10 μm. The resulting substrate was subjected to a polishing process of the present invention.

A wrapping machine equipped with a pair of vertically aligned surface plates was used as a grinder. 25 substrates were sandwiched between the surface plates which were rotating in the opposite direction from each other, and both sides of these substrates were polished by polishing pads provided in the surface plates while supplying a polishing liquid to the surface of the substrates. Suede-type pads (manufactured by Filwel Co., Ltd.) were used at this time as the polishing pads. As a grinder, one 3-way-type double-side polishing machine (model 11B, manufactured by System Seiko Co., Ltd.) was used for the first stage polishing (rough polishing) and the second stage polishing (intermediate polishing), and another was used for the third stage polishing (finish polishing). The polishing liquid was supplied at a rate of 500 ml/minute, the surface plate rotational speed was set to 20 rpm, the processing pressure was set to 110 g/cm$^2$, and the amount of polishing for each side was set to about 1.5 μm in the first stage polishing and about 0.5 μm in the second stage polishing. Note that the amount of polishing in the third stage polishing will be described later.

In the first stage polishing step (rough polishing step) using the first grinder, a polishing was conducted for 3 minutes by supplying a polishing slurry in which alumina abrasive grains having a D50 value of 0.5 μm had been dispersed to a concentration of 5% by mass in an aqueous solution with a pH adjusted to an acidic region of 1.5 by adding a chelating agent and an oxidizing agent thereto. Thereafter, supply of the polishing slurry was cut off, and a polishing was conducted for 2 minutes while supplying water instead.

The polishing slurry that remained in the polishing pads was examined during the 2 minutes of polishing. The amount of alumina abrasive grains contained in the polishing slurry was about 0.1% by mass after 1 minute and was not more than 0.05% by mass after 2 minutes. Thereafter, supply of water was stopped, and a polishing (intermediate polishing step) was conducted for 3 minutes by supplying polishing slurry with a pH adjusted to an acidic region of 1.5 by adding colloidal silica abrasive grains having a D50 value of 30 nm to a concentration of 5% by mass, a chelating agent and an oxidizing agent thereto.

After the second stage polishing step, the polished substrate was washed with water, and the third stage polishing step (finish polishing step) was conducted using the second grinder. In this third stage polishing step, a polishing was conducted for 2 minutes (Example 1) or 4 minutes (Example 2) using a polishing slurry in which colloidal silica abrasive grains having a D50 value of 10 nm had been dispersed to a concentration of 7% by mass in an aqueous solution with a pH adjusted to an acidic region of 1.5 by adding a chelating agent and an oxidizing agent thereto. A polishing was conducted under conditions where the amount of polishing was extremely reduced as compared to the time of production, so that alumina abrasive grains readily remained stuck. Note that the amount of polishing in the present examples 1 and 2 was 0.5 μm at the time of production, and was 0.08 μm when the polishing was conducted for 2 minutes (Example 1) and 0.16 μm when the polishing was conducted for 4 minutes (Example 2). Thereafter, the substrate was washed with water, thereby completing the polishing steps for substrates.

Comparative Examples 1 and 2

In Comparative Examples 1 and 2, the washing with water and the intermediate polishing step using colloidal silica abrasive grains were not conducted at the end of the first stage polishing step. In addition, the first stage polishing step using the first grinder was conducted for 5 minutes and the finish polishing step using the second grinder was conducted for 2 minutes (Comparative Example 1) or 4 minutes (Comparative Example 2). Apart from the above procedures, the polishing steps for substrates were conducted in the same manner as in Examples 1 and 2.

The extent of sticking of alumina abrasive grains was examined for the substrates polished in Examples 1 and 2 and Comparative Examples 1 and 2. Note that for the sticking of alumina abrasive grains, the number of surface defects was counted using a laser-based surface inspection device (OSA6120) manufactured by KLA-Tencor Corporation (U.S.), and the sticking of alumina abrasive grains in these defect portions was verified by energy dispersive X-ray spectroscopy using a scanning electron microscope (SEM/EDX).

As a result, in Example 1, the sticking of alumina abrasive grains reduced by about 75%, as compared to Comparative Example 1. On the other hand, in Example 2, the sticking of alumina abrasive grains reduced by about 27%, as compared to Comparative Example 2.

DESCRIPTION OF THE REFERENCE SYMBOLS

11, 12: Surface plate; 13: Polishing pad; W: Substrate

What is claimed is:

1. A method of producing a substrate for magnetic recording media comprising:

a rough polishing step of polishing a surface of a substrate for magnetic recording media using a first grinder while supplying a polishing liquid containing alumina abrasive grains to the first grinder, wherein the substrate is prepared by forming a NiP plating film on a surface of an Al alloy substrate; and a finish polishing step of polishing the substrate for magnetic recording media following washing, using a second grinder while supplying a polishing liquid containing colloidal silica abrasive grains, after washing the substrate for magnetic recording media, wherein the rough polishing step further comprises a step of stopping supply of the polishing liquid containing alumina abrasive grains and removing alumina abrasive grains from the first grinder by supplying a washing liquid containing no abrasive grains instead at the end of the rough polishing step;

the method of producing a substrate for magnetic recording media further comprises an intermediate polishing step provided for polishing the surface of the substrate for magnetic recording media using the first grinder while supplying a polishing liquid containing colloidal silica abrasive grains after the rough polishing step and before the finish polishing step;

and an average particle size for the colloidal silica abrasive grains used in the finish polishing step is smaller than an average particle size for the colloidal silica abrasive grains used in the intermediate polishing step.

2. The method of producing a substrate for magnetic recording media according to claim 1, wherein water is used as the washing liquid containing no abrasive grains.

3. The method of producing a substrate for magnetic recording media according to claim 2, wherein a volume-based 50% cumulative average particle size (D50) for the colloidal silica abrasive grains used in the finish polishing step is 5 to 180 nm.

4. The method of producing a substrate for magnetic recording media according to claim 1, wherein a volume-based 50% cumulative average particle size (D50) for the alumina abrasive grains used in the rough polishing step is 0.1 to 0.7 μm, and a volume-based 50% cumulative average particle size (D50) for the colloidal silica abrasive grains used in the intermediate polishing step is 15 to 400 nm.

5. The method of producing a substrate for magnetic recording media according to claim 4, wherein a volume-based 50% cumulative average particle size (D50) for the colloidal silica abrasive grains used in the finish polishing step is 5 to 180 nm wherein the volume-based 50% cumulative average particle size (D50) for the colloidal silica abrasive grains used in the finish polishing step is smaller than the volume-based 50% cumulative average particle size (D50) for the colloidal silica abrasive grains used in the intermediate polishing step.

6. The method of producing a substrate for magnetic recording media according to claim 1, wherein a volume-based 50% cumulative average particle size (D50) for the colloidal silica abrasive grains used in the finish polishing step is 5 to 180 nm.

* * * * *